US011709452B2

(12) United States Patent
Funaba

(10) Patent No.: US 11,709,452 B2
(45) Date of Patent: Jul. 25, 2023

(54) IMAGE FORMING APPARATUS AND METHOD FOR CONTROLLING IMAGE FORMING APPARATUS

(71) Applicant: CANON KABUSHIKI KAISHA, Tokyo (JP)

(72) Inventor: Hiroshi Funaba, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/935,655

(22) Filed: Sep. 27, 2022

(65) Prior Publication Data

US 2023/0018207 A1 Jan. 19, 2023

Related U.S. Application Data

(63) Continuation of application No. 17/358,584, filed on Jun. 25, 2021, now Pat. No. 11,487,237.

(30) Foreign Application Priority Data

Jul. 14, 2020 (JP) ..... 2020-120948

(51) Int. Cl.
*G03G 21/16* (2006.01)
*G03G 21/18* (2006.01)
*G03G 15/08* (2006.01)

(52) U.S. Cl.
CPC ..... *G03G 21/1633* (2013.01); *G03G 15/0863* (2013.01); *G03G 21/1652* (2013.01); *G03G 21/1676* (2013.01); *G03G 21/1685* (2013.01); *G03G 21/1878* (2013.01)

(58) Field of Classification Search
CPC ..... G03G 15/0863; G03G 15/55; G03G 21/1633; G03G 21/1652; G03G 21/1676; G03G 21/1685; G03G 21/1875; G03G 21/1878
See application file for complete search history.

(56) References Cited

U.S. PATENT DOCUMENTS

| | | | | |
|---|---|---|---|---|
| 10,663,920 | B2 | 5/2020 | Funaba | |
| 2015/0104200 | A1 | 4/2015 | Matsumoto | |
| 2020/0133197 | A1* | 4/2020 | Kaida | G03G 21/1878 |
| 2021/0096493 | A1 | 4/2021 | Kyotani | |
| 2021/0149331 | A1 | 5/2021 | Kyotani | |

FOREIGN PATENT DOCUMENTS

| | | | |
|---|---|---|---|
| JP | 2005-107113 | A | 4/2005 |
| JP | 4273724 | B2 | 6/2009 |

* cited by examiner

*Primary Examiner* — Sophia S Chen
(74) *Attorney, Agent, or Firm* — Venable LLP

(57) ABSTRACT

An image forming apparatus, to which a replaceable unit with a nonvolatile memory is mounted, including: a storage portion configured to store data related to the replaceable unit read from the memory and hold stored contents even when the image forming apparatus is not activated; a door to be opened when the replaceable unit is replaced; a detector configured to detect whether the door is open or closed; a latch circuit configured to hold a specific state when the detector detects that the door is open when the image forming apparatus is not activated; and a controller configured to, when activating the image forming apparatus, read the data from the memory when the latch circuit is in the specific state, read the data from the storage portion when the latch circuit is not in the specific state, and perform an activation process based on the read data.

10 Claims, 9 Drawing Sheets

IMAGE FORMING APPARATUS AND METHOD FOR CONTROLLING IMAGE FORMING APPARATUS

This application is a continuation of U.S. application Ser. No. 17/358,584, filed Jun. 25, 2021, the contents of which is incorporated by reference herein.

BACKGROUND OF THE INVENTION

Field of the Invention

The present invention relates to an image forming apparatus to which a replaceable unit provided with a memory is mounted, and a method for controlling the image forming apparatus.

Description of the Related Art

In recent years, it has been required to reduce the downtime of a multifunction apparatus by allowing a user to perform unit replacement by simplifying the maintainability of the image forming apparatus such as the multifunction apparatus and providing a configuration in which the unit can be easily replaced. In this type of image forming apparatus, it has been proposed to provide a storage member (hereinafter referred to as memory) such as a memory tag including a nonvolatile memory and a wireless communication unit such as RFID in a replaceable unit such as a consumable part or a replacement unit (Japanese Patent No. 4,273,724 and Japanese Patent Application Laid-open No. 2005-107113).

The memory provided in the replaceable unit stores the characteristic parameter values inherent in the consumable part or the replaceable unit, and the image forming apparatus performs control for setting the image forming conditions so that the image formation becomes an optimum state based on the parameter values read from the memory. As this control, for example, a control for setting the power to be supplied to a fixing unit based on the information of the fixing heater stored in the memory is assumed. Further, it is assumed that the control for setting the output value of the high voltage power source to be used at the time of image formation is performed based on the mixing ratio information of toner and carrier in the developing device stored in the memory.

As described above, when a parameter value inherent in a unit is read from a memory provided in the unit and reflected in the image forming process, it is necessary to read data such as the parameter values from all memories when there is a possibility that the unit has been replaced. That is, when a door for replacing a consumable part or a replacement unit is opened or closed, it is necessary to confirm whether or not the unit has been replaced.

However, in the conventional image forming apparatus, it is not possible to detect that the door is opened or closed when a main power switch of the image forming apparatus is turned off or in a sleep mode (power saving state). For this reason, when the main power switch of the image forming apparatus is turned on or when the image forming apparatus is started up such as when returning from the sleep mode, data is always read out from the memory of each replaceable unit. Therefore, since data is sequentially read from the memories of the respective units every time of recovery, particularly when the number of units to which the memories are mounted is large, the activation time of the image forming apparatus becomes long.

In order to shorten the activation time, a dedicated communication line may be provided for the memory of each unit so that data can be simultaneously read from the memories of the plurality of units. However, when the number of units mounted with the memory increases, a plurality of communication protocols such as IP addresses for communication with CPU and ASIC are required, so that the number of pins of the IC increases and the cost increases.

SUMMARY OF THE INVENTION

In accordance with an embodiment of the present invention, an image forming apparatus to which a replaceable unit provided with a nonvolatile memory is mounted, the image forming apparatus comprises: a storage portion configured to store data related to the replaceable unit read out from the memory provided to the replaceable unit, and hold stored contents even in a state in which the image forming apparatus is not activated; a door to be opened and closed in a case where the replaceable unit is replaced; a detector configured to detect whether the door is in an open state or in a closed state; a latch circuit configured to hold a specific state in a case in which the detector detects that the door is in the open state even in the state in which the image forming apparatus is not activated; a battery configured to supply power to the detector and the latch circuit even in the state in which the image forming apparatus is not activated; and a controller configured to, in a case of activating the image forming apparatus, read out the data from the memory of the replaceable unit in a case in which the latch circuit is in the specific state, read out the data from the storage portion without reading out the data from the memory of the replaceable unit in a case in which the latch circuit is not in the specific state, and perform an activation process of the image forming apparatus based on the read out data.

Further features of the present invention will become apparent from the following description of exemplary embodiments with reference to the attached drawings.

DESCRIPTION OF THE EMBODIMENTS

<Image Forming Apparatus>

Figure 1:
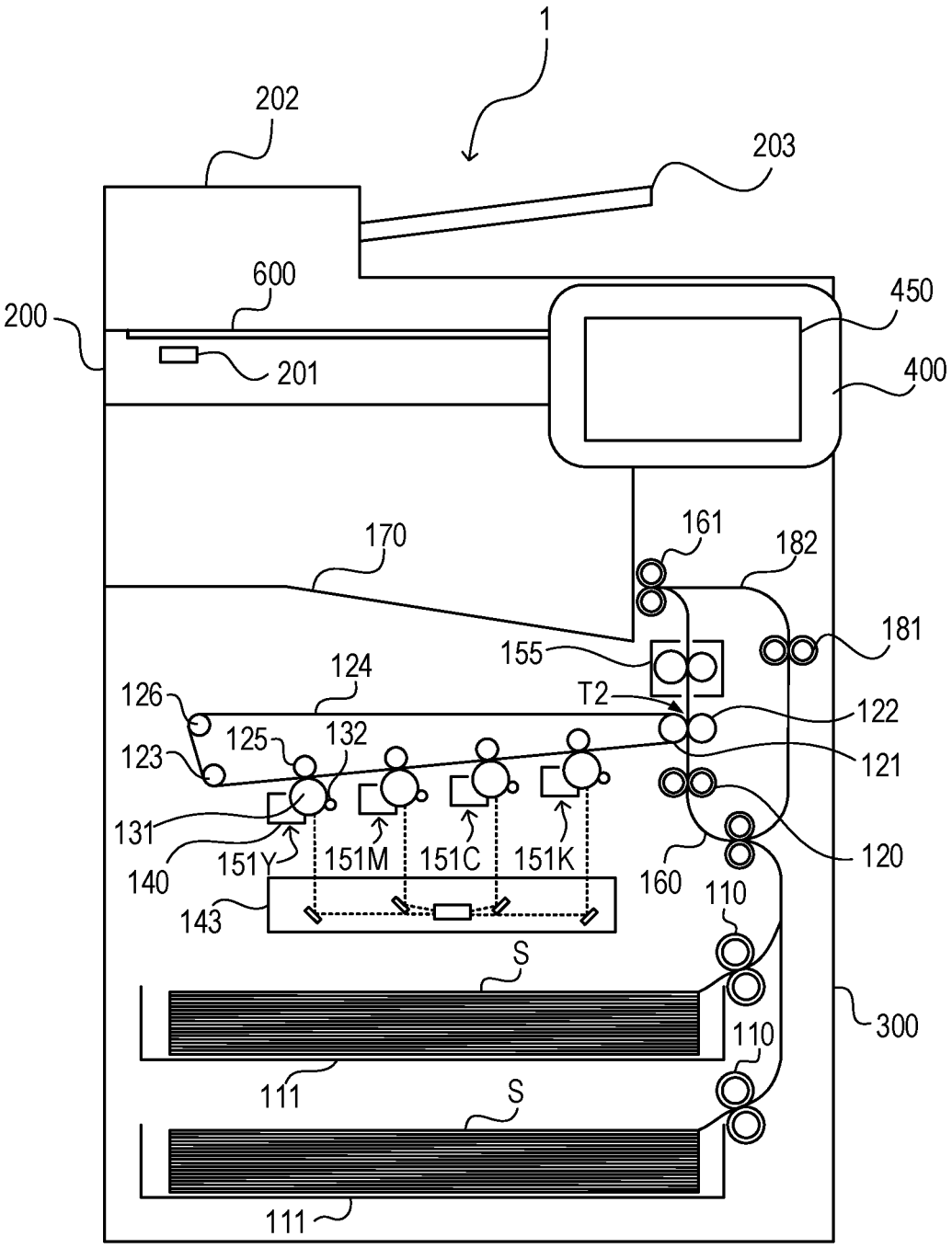
FIG. 1 is a sectional view showing an example of a schematic configuration of an image forming apparatus according to an embodiment.
Figure 2:
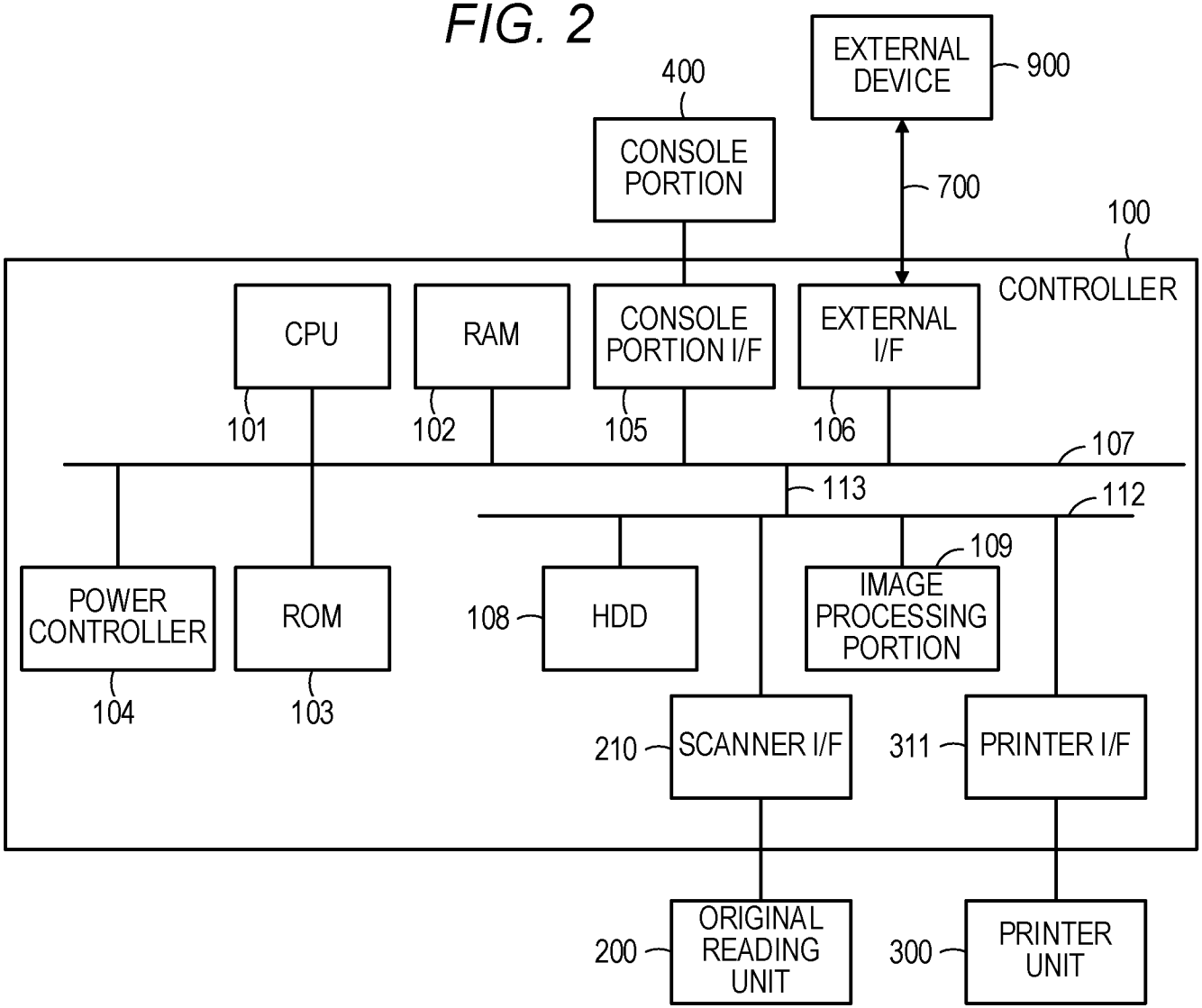
FIG. 2 is a block diagram showing the example of the schematic configuration of the image forming apparatus according to the embodiment.
Figure 9:
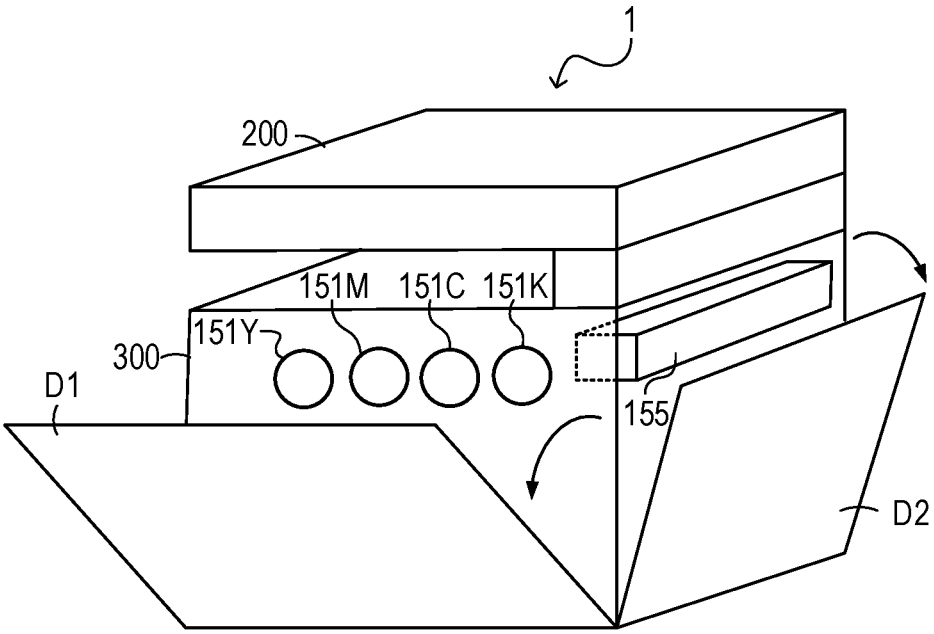
FIG. 9 is an explanatory view of a front door and a right door provided on the printer unit side of the image forming apparatus.

A configuration of an image forming apparatus 1 according to the embodiment will be described below with reference to FIGS. 1, 2 and 9. FIG. 1 is a sectional view showing an example of a schematic configuration of the image forming apparatus 1 according to an embodiment of the present invention. FIG. 2 is a block diagram showing the example of the schematic configuration of the image forming apparatus 1. FIG. 9 is an explanatory view of a front door D1 and a right door D2 provided on a printer unit 300 of the image forming apparatus 1.

In the embodiment, an electrophotographic tandem type full-color printer will be described as an example of the image forming apparatus 1. The image forming apparatus 1 is not limited to an electrophotographic system, but may be another recording system such as an ink jet system. The embodiment is not limited to the tandem type image forming apparatus 1, but is also applicable to other types of image forming apparatuses. The embodiment is applicable not only to the full-color image forming apparatus but also to a monochrome or monocolor image forming apparatus.

As shown in FIGS. 1 and 2, the image forming apparatus 1 of the embodiment includes a controller 100, an original reading unit 200, a printer unit 300, and a console portion 400. As shown in FIG. 2, the controller 100 controls the original reading unit 200, the printer unit 300, and the console portion 400.

The original reading unit 200 is provided on an upper portion of the printer unit 300. The original reading unit 200 includes an original platen 600 on which an original can be placed, an image reading device 201 configured to read an image on the original placed on the original platen 600, and an original conveying portion 202 (ADF) configured to convey a plurality of original sheets continuously to the original platen 600. ADF is an abbreviation for Auto Document Feeder.

The original conveying portion 202 is provided so as to be movable between a closed position in which the original conveying portion 202 covers the original platen 600 of the image reading device 201 and an open position in which the original platen 600 is exposed. The original conveying portion 202 has a pressing plate (not shown) on a bottom surface of the original conveying portion 202, and also has a function of pressing the original on the original platen 600. When an image of the original is read by the image reading device 201, a user lifts the original conveying portion 202 to move it to the open position, sets the original on the original platen 600, and then lowers the original conveying portion 202 to return it to the closed position. At this time, the original placed on the original platen 600 is pressed by the pressing plate provided on the original conveying portion 202, and the image is read by the image reading device 201 in response to a start of copying or scanning.

The original conveying portion 202 has a tray 203 on which the original is placed. The original placed on the tray 203 is conveyed one by one by the original conveying portion 202 to an image reading position of the image reading device 201 in response to the start of copying or scanning, and the image is read. The image read by the image reading device 201 is sent to the controller 100 as image data and stored in the controller 100.

In the embodiment, the image forming apparatus 1 has image forming sections 151Y, 151M, 151C and 151K as an image forming portion configured to form an image on the recording material S in the printer unit 300. The recording material S includes various kinds of sheet materials such as plain paper, thick paper, rough paper, paper having recesses and protrusions, coated paper, glossy paper, photographic paper, plastic film, cloth, and the like.

Hereinafter, the image forming sections 151Y, 151M, 151C, and 151K will be specifically described. The image forming sections 151Y, 151M, 151C and 151K form yellow (Y), magenta (M), cyan (C) and black (B) images, respectively. The image forming sections 151Y, 151M, 151C and 151K are arranged along a circumferential direction of an intermediate transfer belt 124. The image forming sections 151Y, 151M, 151C, and 151K have substantially the same construction except that the color of the toner used is different from yellow, magenta, cyan, and black. Hereinafter, the yellow image forming section 151Y will be described as a representative example, and the explanation of the other image forming sections 151M, 151C, and 151K will be omitted. Therefore, in FIG. 1, for the sake of explanation, only the structures of the image forming section 151Y are indicated by reference numerals.

The image forming section 151Y mainly comprises a photosensitive drum 131, a charging device 132, an exposure device 143, a developing device 140 and the like. The photosensitive drum 131 and the charging device 132 are formed as an integrated drum unit 130Y. The surface of the photosensitive drum 131 that is rotated is uniformly charged in advance by the charging device 132. And then an electrostatic latent image is formed on the surface of the photosensitive drum 131 by an exposure device 143 driven based on image data. Next, the electrostatic latent image formed on the photosensitive drum 131 is developed into a toner image by the developing device 140 using a developer. When a primary transfer voltage is applied to a primary transfer roller 125 sandwiching the intermediate transfer belt 124 between the primary transfer roller 125 and the image forming section 151Y, the toner image formed on the photosensitive drum 131 is transferred onto the intermediate transfer belt 124.

The intermediate transfer belt 124 is stretched around a secondary transfer inner roller 121, a driven roller 126, and a stretching roller 123. The secondary transfer outer roller 122 is disposed at a position opposite to the secondary transfer inner roller 121 across the intermediate transfer belt 124, and forms a secondary transfer nip portion T2 in which the toner image on the intermediate transfer belt 124 is transferred to the recording material S.

A feeding cassette 111 on which the recording materials S are placed is arranged in a lower portion of the printer unit 300. The recording materials S are supplied one by one from the feeding cassette 111 to a conveyance path 160 by a feed roller 110. The recording material S supplied from the feeding cassette 111 is fed to a pair of registration rollers 120 through the conveyance path 160. The registration rollers 120 receive the recording material S once to correct a skew feed of the recording material S, and then conveys the recording material S to the secondary transfer nip portion T2 in accordance with the formation timing of the toner image on the intermediate transfer belt 124 in the image forming sections 151Y, 151M, 151C and 151K. When the secondary transfer bias is applied to the secondary transfer outer roller 122, the toner image on the intermediate transfer belt 124 is transferred to the recording material S in the secondary transfer nip portion T2. Thereafter, the recording material S is conveyed toward a fixing unit 155. In the fixing unit 155, as the recording material S is nipped and conveyed by a pair of rollers forming a fixing nip portion, the toner image is heated and pressurized to be fixed to the recording material S.

When the toner image is formed only on one side of the recording material S, the recording material S passing through the fixing unit 155 is discharged onto a discharge tray 170 by a pair of discharge rollers 161. When toner images are formed on both sides of the recording material S, the recording material S that has passed through the fixing unit 155 is switchback conveyed toward a duplex conveyance path 182 by the pair of discharge rollers 161. The recording material S conveyed to the duplex conveyance path 182 is returned to the conveyance path 160 by a pair of conveying rollers 181, and a toner image is formed on the other side of the recording material S through the same process as in the case of forming the toner image on one side of the recording material S. The recording material S having the toner images fixed on both sides is discharged onto the discharge tray 170 by the pair of discharge rollers 161.

Figure 3:
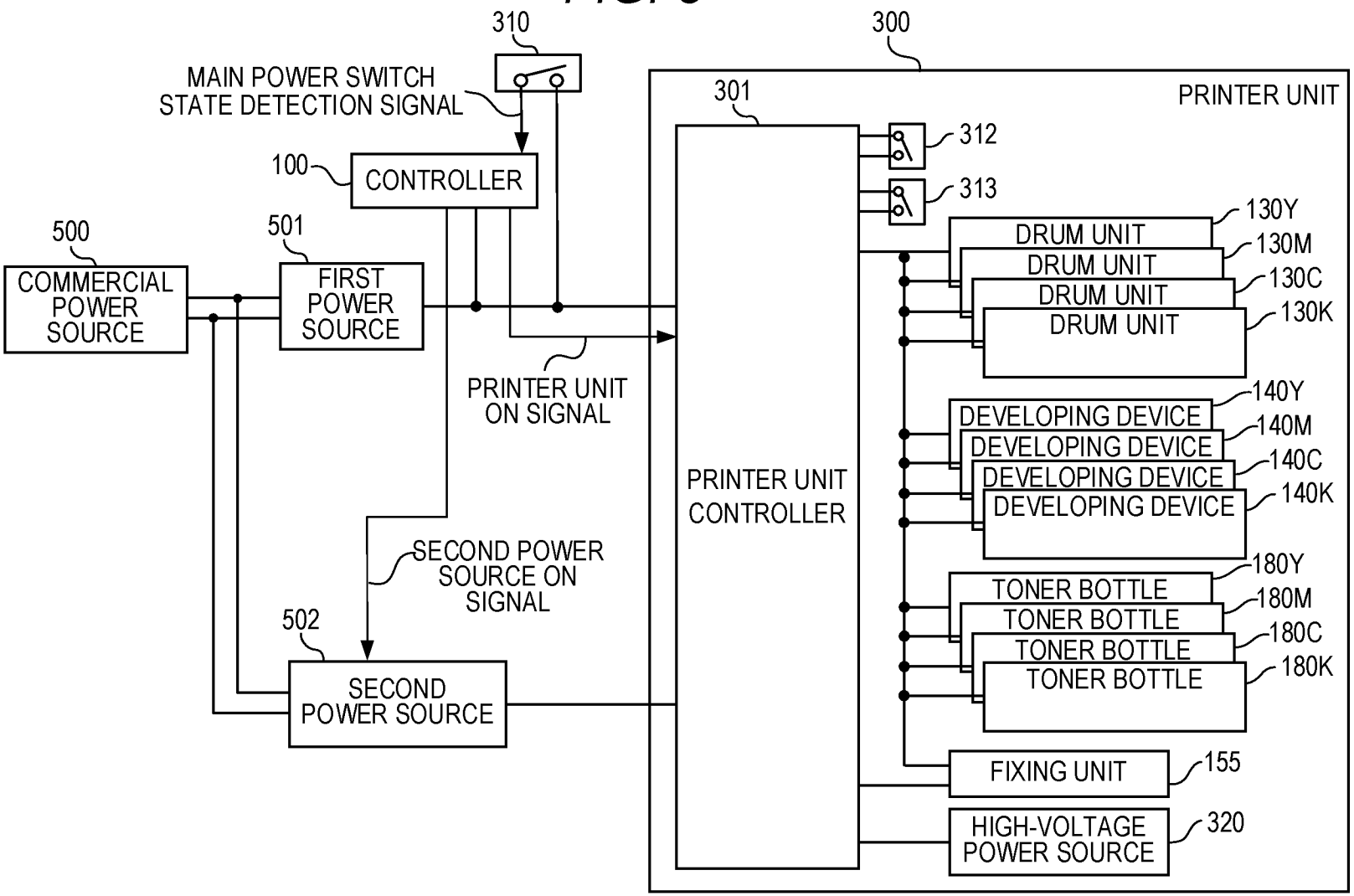
FIG. 3 is an explanatory diagram of a printer unit provided in the image forming apparatus.

The image forming apparatus 1 has the console portion 400 provided with a display portion 450 through which a user can input operation instructions. Further, as shown in FIG. 9, a right door D2 is provided on the right side of the printer unit 300 so as to be openable and closable, and a front door D1 is provided on the front side of the printer unit 300 so as to be openable and closable. The printer unit 300 is equipped with replaceable units such as the fixing unit 155, the developing device 140, the drum unit 130, and toner bottles 180Y to 180K (FIG. 3). The right door D2 is opened and closed when the fixing unit 155 is replaced. The front door D1 is opened and closed when the developing device 140, the drum unit 130, and the toner bottles 180 (i.e., toner bottles 180Y to 180K in FIG. 3) are replaced. The toner bottles 180Y-180K are a consumable article which is configured to be detachably mounted to the printer unit 300 and supplies toner to the developing device 140.

In the embodiment, the printer unit is provided with two doors that open and close when a replaceable unit is replaced (the front door D1 and the right door D2 in FIG. 9), but the printer unit 300 may be provided with three or more doors or one door.

<Controller>

Here, the configuration of the controller 100 provided in the image forming apparatus 1 will be described.

As shown in FIG. 2, the controller 100 includes, for example, a CPU (Central Processing Unit) 101 and a RAM (Random Access Memory) 102 which temporarily stores data. The controller 100 is provided with a ROM (Read Only Memory) 103 which stores a program for controlling each portion and a hard disk device (HDD 108). Note that another storage device such as an SSD (Solid State Drive) may be provided in place of or in combination with the HDD 108.

Further, the controller 100 has a system bus 107 and an image data bus 112 connected to each other by a bus bridge 113. The CPU 101, the RAM 102, and the ROM 103 are connected to the system bus 107, and the HDD 108 is connected to the image data bus 112. The bus bridge 113 connects the system bus 107 and the image data bus 112 which are transferable image data and screen data at high speed, and converts a data structure so that the system bus 107 and the image data bus 112 mutually transmit and receive data.

The CPU 101 is a processor that comprehensively controls the image forming apparatus 1 and is the main part of the controller 100. For example, the CPU 101 instructs the original reading unit 200 to start an original reading operation, instructs the printer unit 300 to start an image forming process, and controls the console portion 400.

The RAM 102 is a system work memory with which the CPU 101 operates, and also serves as an image memory which temporarily stores image data. The RAM 102 functions as a main memory and a work area of the CPU 101. The RAM 102 stores setting information in the image forming apparatus 1 and job logs when various programs are executed. The ROM 103 stores, for example, an original reading job program for reading an original, an image forming job program for forming an image on the recording material S, a main processing program (FIG. 5) to be described later, and the like. The CPU 101 can operate the original reading unit 200 and the printer unit 300 by loading and executing the programs stored in the ROM 103 or the HDD 108 or the like in the RAM 102 as necessary. The HDD 108 can store various programs such as a system program and an application program, image data used for image formation, and various data such as screen data to be displayed on the display portion 450.

The controller 100 includes a power controller 104, a console portion input/output circuit (console portion I/F) 105, and an external input/output circuit (external I/F) 106, each of which is connected to the system bus 107.

The power controller 104 controls power to be supplied to each portion of the image forming apparatus 1 in accordance with turning on/off of a main power switch 310 (shown in FIG. 3, which will be described later) of the image forming apparatus 1. The console portion I/F 105 transmits screen data to the console portion 400, which will be described later, and receives various types of data transmitted from the console portion 400.

The external I/F 106 performs data communication with an external device 900 (external equipment) such as a personal computer or a smartphone connected via a wired or wireless communication network 700. That is, the external I/F 106 can be connected to, for example, a LAN or a public line under the control of the controller 100 to perform input/output control of image data, screen data or device information with the external device 900. In the embodiment, the external I/F 106 can transmit image data relating to an image of the original read by the image reading device 201 to the external device 900.

The controller 100 further includes a scanner input/output circuit (scanner I/F) 210, a printer input/output circuit (printer I/F) 311, and an image processing portion 109, each of which is connected to the image data bus 112.

The scanner I/F 210 is connected the original reading unit 200, and transmits an instruction to start an original reading operation from the CPU 101, and receives image data of the original read by the original reading unit 200.

The printer I/F 311 is connected the printer unit 300, and transmits an instruction to start image forming processing from the CPU 101, transmits image data, or receives data relating to an operation state transmitted from the printer unit 300.

The image processing portion 109 corrects, processes, and edits image data received from the original reading unit 200, for example, and performs resolution conversion on the image data when the image data is transmitted to the printer unit 300. The image processing portion 109 can encrypt image data or decrypt encrypted image data.

<Printer Unit>

FIG. 3 is a diagram for explaining the printer unit 300 provided in the image forming apparatus 1. The printer unit 300 is provided with a first power source 501 connected to a commercial power source 500 and a second power source 502. The first power source 501 generates a predetermined DC voltage from an AC voltage supplied from the commercial power source 500 and supplies the predetermined DC voltage to the controller 100 and the printer unit controller 301. The printer unit controller 301 supplies power to an internal circuit based on a printer unit ON signal from the controller 100 by a circuit described later.

The second power source 502 is controlled by a second power source ON signal output from the controller 100, generates a predetermined DC voltage from the AC voltage supplied from the commercial power source 500, and supplies the predetermined DC voltage to the printer unit controller 301.

One terminal of the main power switch 310 is connected to the voltage generated by the first power source 501. The other terminal of the main power switch 310 is connected to the controller 100 so as to output a main power switch state detection signal. Regardless of the state of the main power switch 310, in a state in which the power is supplied from the commercial power source 500 to the first power source 501, the first power source 501 outputs the predetermined DC voltage. When the main power switch 310 is turned on, the main power switch state detection signal inputted to the controller 100 is changed from a low level (hereinafter referred to as L level) to a high level (hereinafter referred to as H level). When the controller 100 detects that the main power switch state detection signal is at the H level, the controller 100 outputs a second power source ON signal for activating the second power source 502 from the power controller 104.

The printer unit controller 301 controls each portion of the printer unit 300. When the second power source 502 is activated by the controller 100, the printer unit controller 301 supplies the voltage generated by the second power source 502 to each unit required for image formation.

The printer unit 300 has a plurality of replaceable units required to perform the image forming processing described above. The plurality of replaceable units are controlled by the printer unit controller 301. The plurality of replaceable units are, for example, the drum units 130Y, 130M, 130C, 130K, the developing devices 140Y, 140M, 140C, 140K, the toner bottles 180Y, 180M, 180C, 180K, and the fixing unit 155.

The printer unit 300 includes a high-voltage power source 320 and a motor serving as a driving source for various driving units. The printer unit 300 further includes a front door switch (detector) 312 configured to detect whether the front door D1 is in an open state or in a closed state, and a right door switch (detector) 313 configured to detect whether the right door D2 is in an open state or in a closed state. Although the details will be described with reference to FIG. 4, the voltage state of the front door switch 312 changes depending on whether the front door D1 is in the open state or in the closed state. Similarly, the voltage state of the right door switch 313 changes depending on whether the right door D2 is in the open state or in the closed state.

<Configuration Circuit of Printer Unit Controller>

Figure 4:
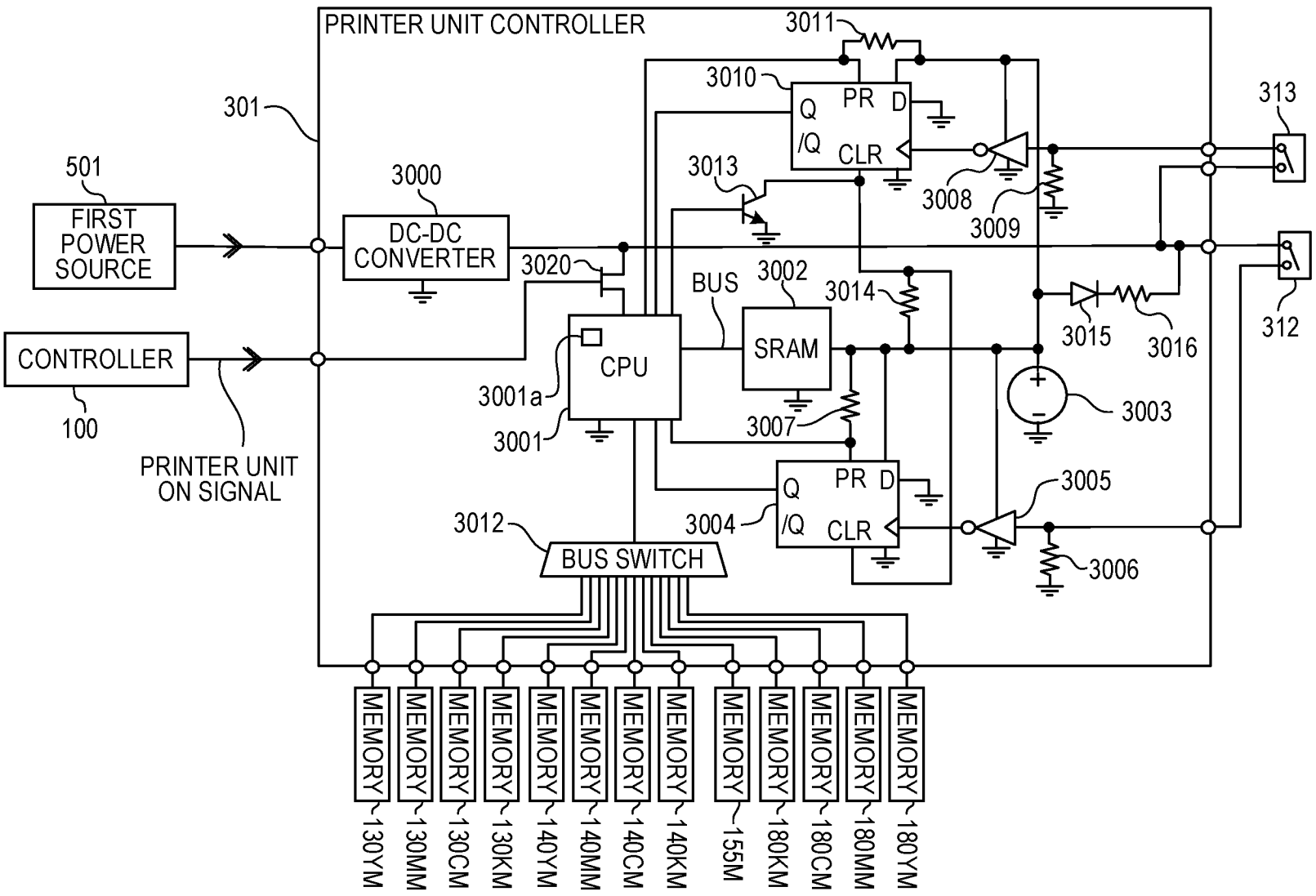
FIG. 4 is an explanatory diagram of a circuit of a printer unit controller.

FIG. 4 is a diagram for explaining a configuration circuit of the printer unit controller 301. The printer unit controller 301 includes a DC-DC converter 3000, a CPU 3001, a static random access memory (hereinafter referred to as SRAM) 3002, and a battery 3003.

The DC-DC converter 3000 converts the voltage from the first power source 501 to generate an internal voltage. The CPU 3001 executes a program stored in a flash memory 3001*a* included in the CPU 3001 to execute various operations and controls. The SRAM (storage portion) 3002 is connected to the CPU 3001 by a bus and functions as a temporary memory for executing various kinds of control and a memory for storing backup values of control values. The battery 3003 is connected as a power source for the SRAM 3002 or the like. The control circuit including the CPU 3001 is supplied with power by energizing the FET 3020 by the printer unit ON signal outputted from the controller 100.

The output voltage of the DC-DC converter 3000 is connected to one terminal of the front door switch 312. The other terminal of the front door switch 312 is connected via an inverter 3005 to a clock terminal of a D flip-flop (hereinafter referred to as a latch circuit) 3004 which is a latch circuit.

A power is supplied from a battery 3003 to the latch circuit 3004. A terminal D of the latch circuit 3004 is connected to ground. A terminal Q (output terminal) is connected to an input terminal of the CPU 3001. A terminal CLR is connected to the battery 3003 via a resistor 3014, and is connected to the output terminal of the CPU 3001 via a transistor 3013. The terminal CLR is "L" active. A preset terminal PR is connected to the battery 3003 via a resistor 3007, and is also connected to the output terminal of the CPU 3001. The terminal PR is "L" active.

When the front door D1 is opened, the front door switch 312 is opened, so that the input voltage of the input portion of the inverter 3005 becomes "L" level by the resistor 3006. That is, the output voltage of the inverter 3005 is switched from the "L" level to the "H" level when the front door switch 312 is opened. The output of the inverter 3005 is input to the terminal CLR of the latch circuit 3004. When the output of the inverter 3005 is switched from the "L" level to the "H" level, the latch circuit 3004 stores the value ("L" level because terminal D is connected to ground) of the terminal D at that time and outputs it to the terminal Q. That is, the output of the terminal Q is at the "L" level. The output of the latch circuit 3004 is maintained in this state until the terminal PR becomes "L" level. That is, the latch circuit 3004 holds a specific state based on a change in the voltage input from the inverter 3005 in response to a predetermined change in the voltage state of the front door switch 312 (In this example, the output of the terminal Q is held at the "L" level, but the present invention is not limited thereto.).

The CPU 3001 can detect that the front door D1 is opened by detecting that the output terminal Q of the latch circuit 3004 is "L". When the CPU 3001 detects that the output terminal Q of the latch circuit 3004 is "L" with a sequence to be described later, the CPU 3001 performs clearing processing by setting the terminal PR to "L" after executing predetermined control. By the clearing process, the output terminal Q becomes "H" level, and the specific state of the latch circuit 3004 is released. As described above, since the power is supplied from the battery 3003 to the latch circuit 3004, even if the main power switch 310 is turned off, the open/close states of the front door switch 312 and the right door switch 313 can be detected. Further, since the terminal CLR of the latch circuit 3004 is connected to the battery 3003 via the resistor 3014, even when the power cable of the image forming apparatus is disconnected, the detection state of door opening/closing can be maintained.

The right door switch 313 constitutes the same circuit as the front door switch 312 together with a latch circuit 3010, an inverter 3008, and resistors 3009 and 3011, and can perform the same detection (for the same structures, the description is omitted.).

In addition to the DC-DC converter 3000, as a power source connected to the right door switch 313 and the front door switch 312, the voltage of the battery 3003 is connected to the right door switch 313 and the front door switch 312 via the diode 3015 and the resistor 3016. Therefore, when there is no output voltage of the DC-DC converter 3000, the voltage from the battery 3003 is supplied to the right door switch 313 and the front door switch 312.

In addition, a nonvolatile memory configured to store information inherent in each unit, a replacement unit counter, and the like is mounted on the aforementioned replacement unit. The drum units 130Y, 130M, 130C, and 130K are respectively mounted with drum memories 130YM, 130MM, 130CM, and 130KM. The developing devices 140Y, 140M, 140C, and 140K are mounted with developing device memories 140YM, 140MM, 140CM, and 140KM, respectively. The toner bottles 180Y, 180M, 180C, and 180K are mounted with toner bottle memories 180YM, 180MM, 180CM, and 180KM, respectively. The fixing unit 155A is mounted with a fixing unit memory 155M. A data line for communication is connected to the respective memories and the CPU 3001 via a bus switch 3012. The CPU 3001 performs communication by switching the channel of the bus switch 3012 according to the memory to be accessed. The memory provided in the replacement unit may be a non-contact IC chip or the like. In this case, the image forming apparatus 1 is provided with a non-contact communication unit configured to communicate with the non-contact IC chip and read out data from the non-contact IC chip. The SRAM 3002 is backed up by the battery 3003, so that the storage contents can be held even when the image forming apparatus 1 is not activated. However, instead of the SRAM 3002 backed up by the battery 3003, a nonvolatile memory such as a flash memory may be used to store control values such as data read out from the memory of each unit.

<Main Processing>

Figure 5:
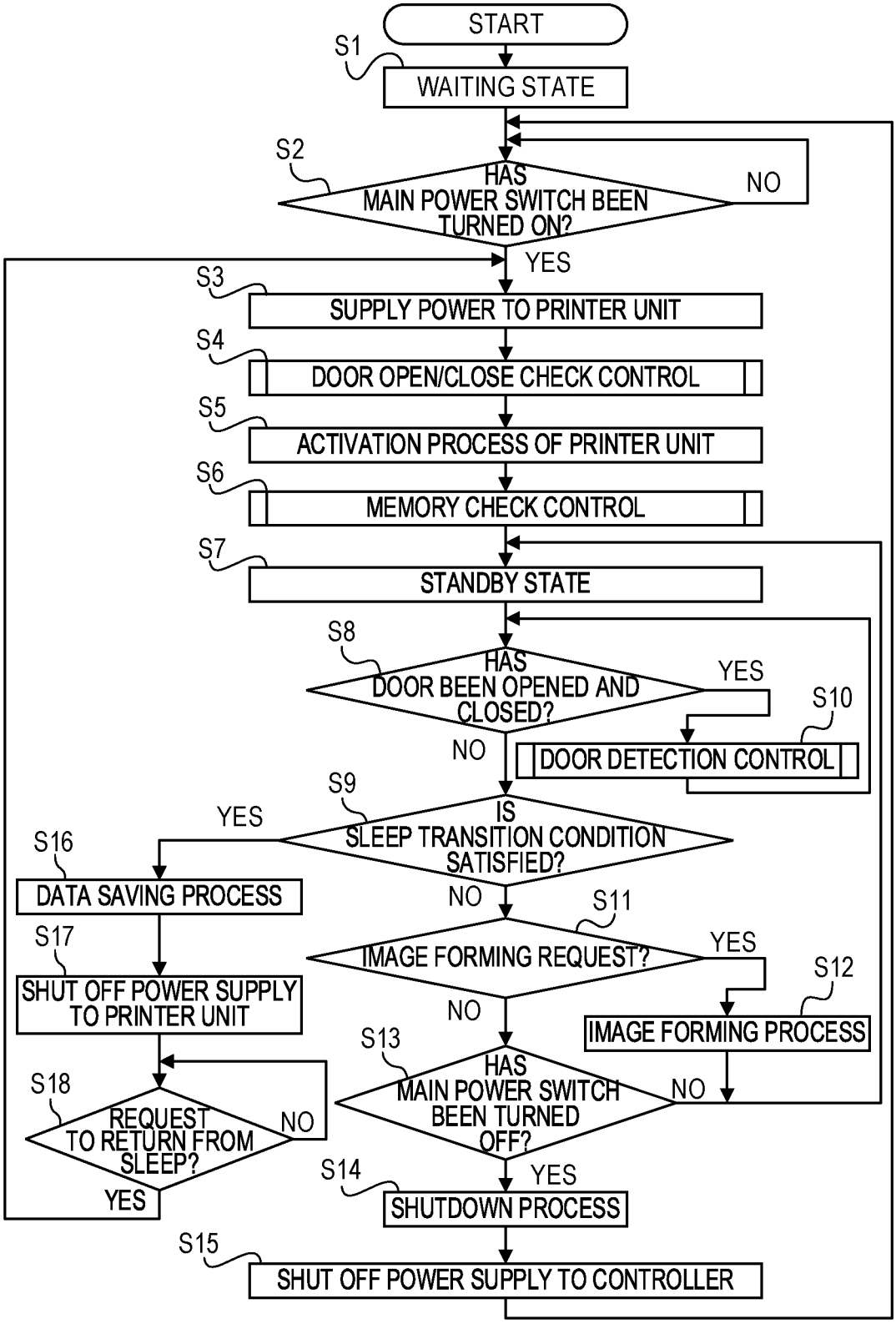
FIG. 5 is a flowchart showing an example of a main processing of the image forming apparatus.

Next, the main processing of the image forming apparatus 1 will be described. FIG. 5 is a flowchart showing an example of the main processing of the image forming apparatus 1 of the embodiment. This main processing is executed by the controller 100 (in particular, by CPU 101). That is, the CPU 101 executes the main processing by loading a program stored in the ROM 103 or the HDD 108 into the RAM 102 and executing the program as necessary.

When the power plug of the image forming apparatus 1 is connected to the commercial power source 500 and the power is supplied from the first power source 501 to the controller 100, the CPU 101 performs an initial process or the like to put the image forming apparatus 1 in a waiting state (S1), and advances the process to S2. The waiting state is a state in which the CPU 101 is waiting for the main power switch 310 to be turned on in order to activate the image forming apparatus 1.

In S2, the CPU 101 monitors that the main power switch 310 is turned on. When the main power switch 310 is not turned on, that is, when the CPU 101 does not detect that the main power switch state detection signal (FIG. 3) becomes H level (NO in S2), the CPU 101 maintains the waiting state and continues monitoring the main power switch 310.

On the other hand, when the main power switch 310 is turned on by the user, that is, when the CPU 101 detects that the main power switch state detection signal is at the H level (YES in S2), the CPU 101 advances the process to S3.

In S3, the CPU 101 controls to start power supply to the printer unit 300 (S3). In the control for starting the power supply, the CPU 3001 of the printer unit controller 301 is energized by the printer unit ON signal and the second power source ON signal of the controller 100, and the second power source 502 is supplied to the printer unit 300.

Figure 6:
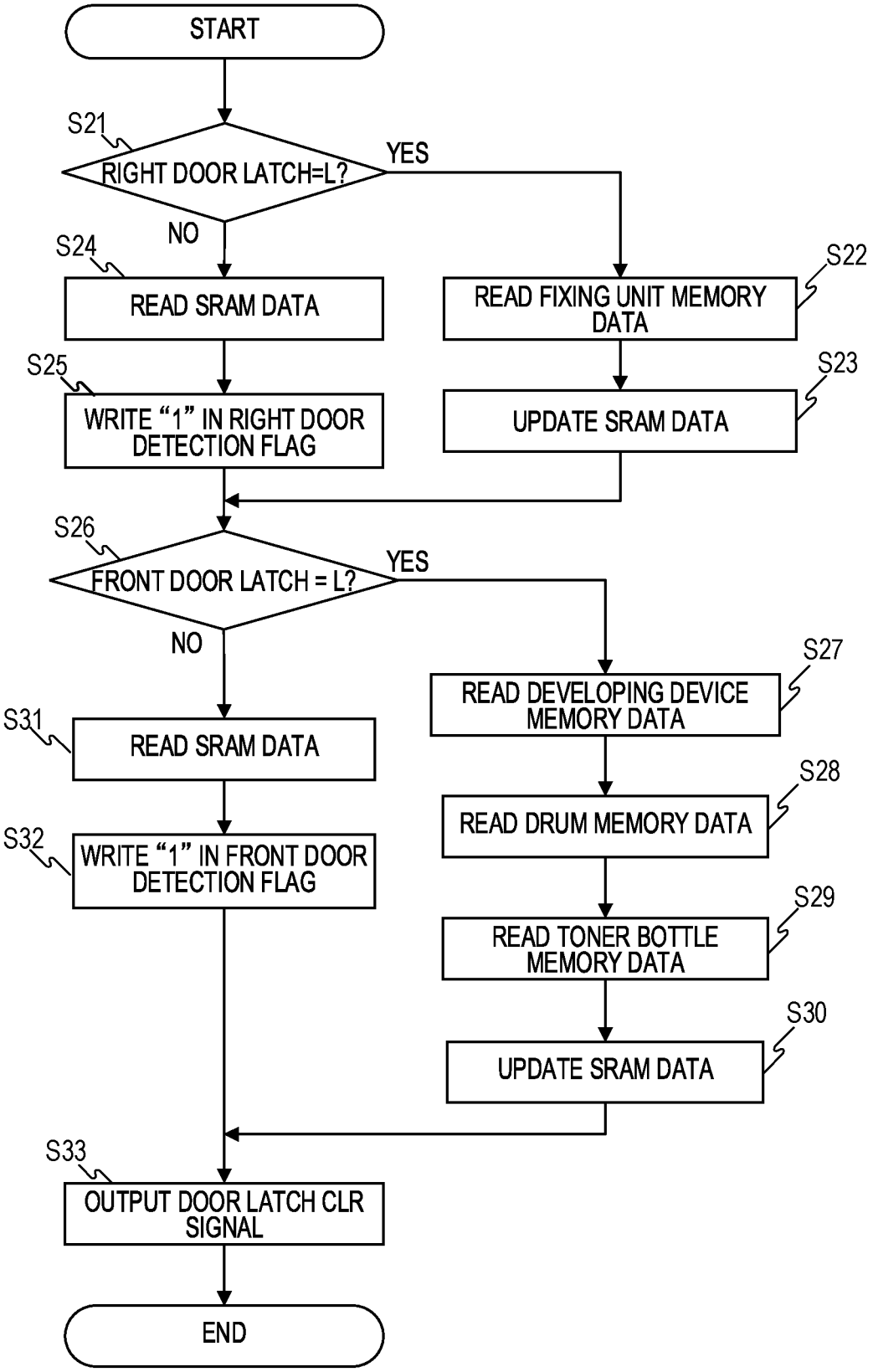
FIG. 6 is a flowchart showing an example of door open/close check control of the image forming apparatus.

Thereafter, in S4, the CPU 101 instructs the printer unit controller 301 to execute the door open/close check control. The details of the door open/close check control are shown in FIG. 6 to be described later. When the door detection control ends, the CPU 101 advances the process to S5. In S5, the CPU 101 starts the activation process of the printer unit 300 and advances the process to S6.

Figure 7:
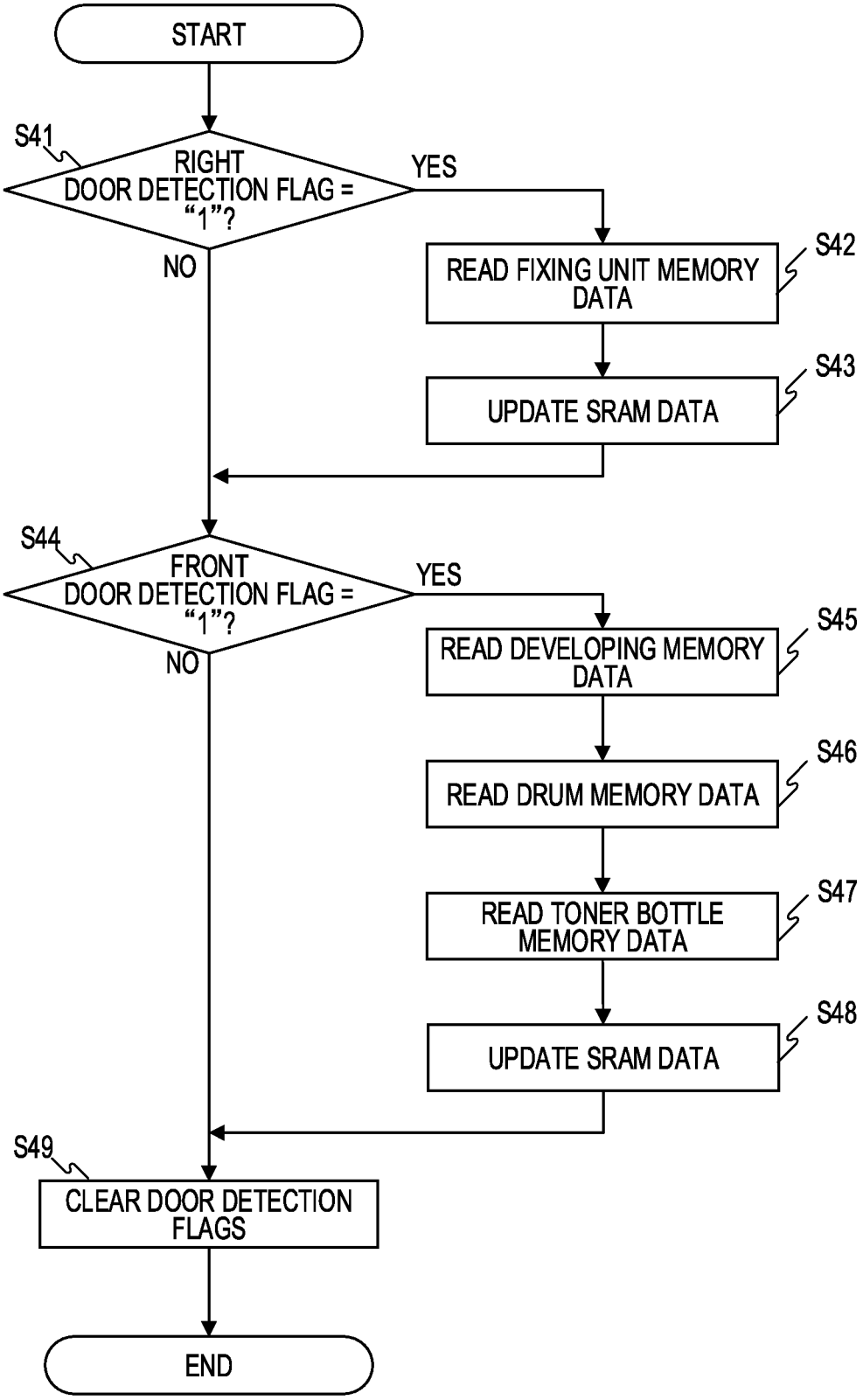
FIG. 7 is a flowchart showing an example of memory check control of the image forming apparatus.

In S6, the CPU 101 instructs the printer unit controller 301 to execute the memory check control. The details of the memory check control are shown in FIG. 7, which will be described later. When the memory check control is completed, the CPU 101 advances the process to S7. Next, in S7, the CPU 101 shifts to a standby state. The standby state is a state in which the CPU 101 is waiting for input of an instruction to start image formation.

Figure 8:
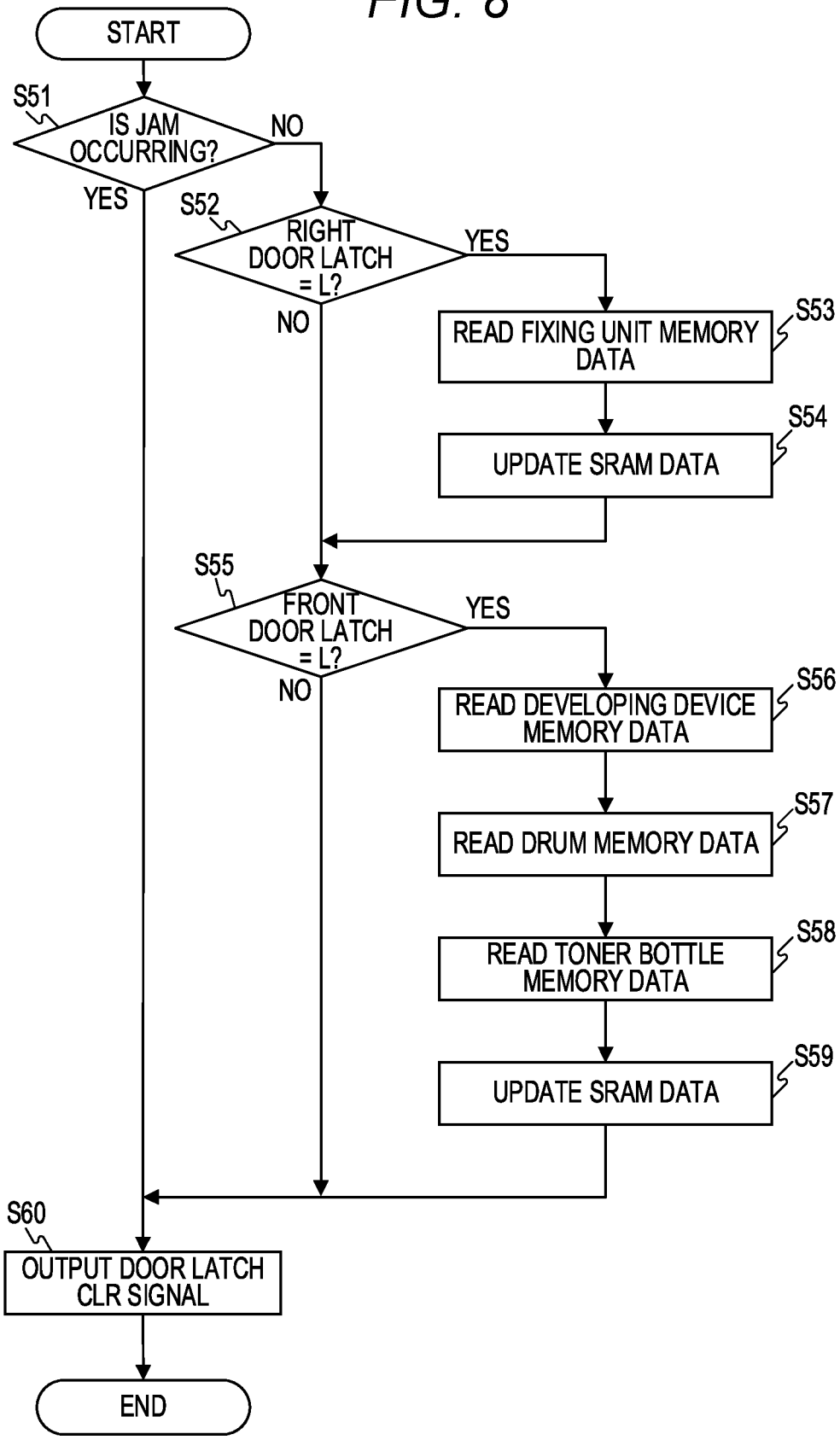
FIG. 8 is a flowchart showing an example of door detection control of the image forming apparatus.

In the standby state, the CPU 101 determines whether the door (the front door D1, the right door D2) is opened or closed (S8). When the door is opened or closed (YES in S8), the CPU 101 advances the process to S10. In S10, the CPU 101 instructs the printer unit controller 301 to execute the door detection control. The details of the door detection control are shown in FIG. 8, which will be described later. When the door detection control ends, the CPU 101 returns the process to S8.

On the other hand, if the door is not opened or closed (NO at S8), the CPU 101 advances the process to S9. In S9, the CPU 101 determines whether the sleep transition condition is satisfied. If the sleep transition condition is not satisfied (NO in S9), the CPU 101 advances the process to S11.

In S11, the CPU 101 determines whether an image forming request has been notified. When there is an image forming request (YES in S11), the CPU 101 advances the process to S12. In S12, the CPU 101 executes the image forming process and returns to the standby state (S7).

On the other hand, when there is no image forming request (NO in S11), the CPU 101 advances the process to S13. In S13, the CPU 101 determines whether the main power switch 310 is turned off. If the main power switch 310 is not turned off (NO in S13), the CPU 101 returns to the standby state (S7).

On the other hand, when the main power switch 310 is turned off by the user (YES in S13), the CPU 101 advances the process to S14. In S14, the CPU 101 executes a predetermined shutdown process. Further, in S15, the CPU 101 shuts off the power supply to the printer unit controller 301 and the controller 100, shifts to the waiting state, and monitors that the main power switch 310 is turned on (S2).

In the standby state, when the sleep transition condition is satisfied (YES in S9), the CPU 101 advances the process to S16. In S16, the CPU 101 executes necessary backup value saving process to record data in the HDD 108 (data saving process). Next, in S17, the CPU 101 shuts off the power supply to the printer unit 300. That is, the state is shifted to a power saving state (sleep state) in which the power consumption is smaller than that of the standby state.

Thereafter, in S18, the CPU 101 monitors whether there is a request to return from the sleep state (Hereinafter referred to as a wake request). When there is no wake request (NO in S18), the CPU 101 maintains the state as it is and continues monitoring the wake request. On the other hand, when there is a request to return to sleep (YES in S18), the CPU 101 returns the process to S3 and starts power supply to the printer unit 300. That is, it returns from the power-saving state.

<Door Open/Close Check Control>

The "door open/close check control" shown in S4 of FIG. 5 will be described. FIG. 6 is a flowchart showing an example of door open/close check control. The door open/close check control is executed by the printer unit controller 301 (in particular, CPU 3001). That is, the CPU 3001 executes the door open/close check control by executing the program stored in the flash memory 3001*a* inside the CPU 3001.

First, in S21, the CPU 3001 checks the output (right door latch signal) of the terminal Q of the latch circuit 3010 of the right door switch 313. When the right door latch signal is "L" (YES in S21), the CPU 3001 advances the process to S22. In this case, it means that the right door D2 is opened and closed before the main power switch 310 is turned on. That is, there is a possibility that the fixing unit 155 has been replaced. In S22, the CPU 3001 reads data (fixing unit memory data) related to the fixing unit 155 from the fixing unit memory 155M mounted on the fixing unit 155. Further, in S23, the CPU 3001 writes the fixing unit memory data read in S22 into the SRAM 3002 and advances the process to S26.

On the other hand, when the right door latch signal is "H" (NO in S21), the CPU 3001 advances the process to S24. In this case, it means that the right door D2 was not opened before the main power switch 310 was turned on. That is, the fixing unit 155 was not replaced. In S24, the CPU 3001 reads out the fixing unit memory data stored in the SRAM 3002. In this case, the CPU 3001 does not read out the fixing unit memory data from the fixing unit memory 155M. Further, in S25, the CPU 3001 writes "1" in the right door detection flag of the SRAM 3002, and advances the process to S26.

Although not shown, in the case of NO in S21, the CPU 3001 may perform the following control. For example, the CPU 3001 accesses the fixing unit memory 155M without reading out the fixing unit memory data from the fixing unit memory 155M mounted on the fixing unit 155. For example, the CPU 3001 performs an access which can be processed in a short time such as acquiring an ID of the fixing unit memory 155M as the access. According to the success or failure of the access, the CPU 3001 checks whether or not the fixing unit is mounted, and if the fixing unit 155 is mounted, the process proceeds to S26, and if the fixing unit is not mounted, an error process is performed. By confirming the mounting of the fixing unit 155 by the type of memory access which can be processed in a short time, the mounting of the fixing unit 155 can be confirmed in a short time as compared with the case of reading out the fixing unit memory data.

In S26, the CPU 3001 checks the output (front door latch signal) of the terminal Q of the latch circuit 3004 of the front door switch 312. When the front door latch signal is "L" (YES in S26), the CPU 3001 advances the process to S27. In this case, it means that the front door D1 is opened and closed before the main power switch 310 is turned on. That is, there is a possibility that any of the developing device 140, the drum unit 130, and the toner bottle 180 has been replaced.

In S27, the CPU 3001 reads out data (developing device memory data) related to the respective developing devices 140Y, 140M, 140C, and 140K from the developing device memories 140YM, 140MM, 140CM, and 140KM mounted on the developing devices 140Y, 140M, 140C, and 140K, respectively.

In S28, the CPU 3001 reads out data (drum memory data) related to the drum units 130Y, 130M, 130C, 130K from drum memories 130YM, 130MM, 130CM, 130KM mounted on the drum units 130Y, 130M, 130C, 130K, respectively.

In S29, the CPU 3001 reads out data (toner bottle memory data) related to the toner bottles 180Y, 180M, 180C, 180K from the toner bottle memories 180YM, 180MM, 180CM, 180KM mounted on the toner bottles 180Y, 180M, 180C, 180K, respectively.

Further, in S30, the CPU 3001 writes the developing device memory data, the drum memory data, and the toner bottle memory data read out in S27 to S29 into the SRAM 3002, and advances the process to S33.

On the other hand, when the front door latch signal is "H" (NO in S26), the CPU 3001 advances the process to S31. In this case, it means that the front door D1 was not opened before the main power switch 310 was turned on. That is, none of the developing device 140, the drum unit 130, and the toner bottle 180 is replaced. In S31, the CPU 3001 reads out developing device memory data, drum memory data, and toner bottle memory data stored in the SRAM 3002. In this case, the CPU 3001 does not read out each developing device memory data, each drum memory data, and each toner bottle memory data from the memories of each unit. Further, in S32, the CPU 3001 writes "1" in the front door detection flag of the SRAM 3002, and advances the process to S33.

Although not shown, in the case of NO in S26, the CPU 3001 may perform the following control. For example, the CPU 3001 accesses the respective developing device memories 140YM, 140MM, 140CM, 140KM, the respective drum memories 130YM, 130MM, 130CM, 130KM, and the respective toner bottle memories 180YM, 180MM, 180CM, 180KM without reading out the developing device memory data, the drum memory data, and the toner bottle memory data from the respective developing device memories 140YM, 140MM, 140CM, 140KM, the respective drum memories 130YM, 130MM, 130CM, 130KM, and the respective toner bottle memories 180YM, 180MM, 180CM, 180KM. For example, the CPU 3001 performs an access which can be processed in a short time such as acquiring IDs of the developing device memories 140YM, 140MM, 140CM, 140KM, the drum memories 130YM, 130MM, 130CM, 130KM, and the toner bottle memories 180YM, 180MM, 180CM, 180KM as the access. According to the success or failure of the access, the CPU 3001 checks whether or not the unit having the memory is mounted, and if the unit is mounted, the process proceeds to S33, and if the unit is not mounted, the error process is performed. By confirming the mounting of the unit by the memory access of the type which can be processed in a short time, the mounting of the developing devices 140Y, 140M, 140C, 140K, the drum units 130Y, 130M, 130C, 130K, and the toner bottles 180Y, 180M, 180C, 180K can be confirmed in a short time compared with reading out the developing device memory data, the drum memory data, and the toner bottle memory data.

In S33, the CPU 3001 outputs a CLR signal (L level) to the terminals PR of the latch circuit 3004 and the latch circuit 3010, respectively, and clears the latch circuit 3004 and the latch circuit 3010, thereby ending the processing of the flowchart. If NO in S21, the CLR signal output to the latch circuit 3004 may be omitted. If NO in S26, the CLR signal output to the latch circuit 3010 may be omitted.

<Memory Check Control>

The "memory check control" shown in S6 of FIG. 5 will be described. FIG. 7 is a flowchart showing an example of memory check control. The door open/close check control is executed by the printer unit controller 301 (in particular, CPU 3001). That is, the CPU 3001 executes a program stored in the flash memory 3001*a* inside the CPU 3001 to execute memory check control.

First, in S41, the CPU 3001 checks the right door detection flag stored in the SRAM 3002. When the right door detection flag is "1" (YES in S41), since the right door D2 has not been opened and the data of the fixing unit memory 155M has not yet been read out before the main power switch 310 is turned on, the CPU 3001 advances the process to S42. In S42, the CPU 3001 reads out data from the fixing unit memory 155M mounted on the fixing unit 155. Further, in S43, the CPU 3001 writes the data of the fixing unit memory 155M read out in S22 into the SRAM 3002 and advances the process to S44.

On the other hand, when the right door detection flag is "0" (NO in S41), the right door D2 is opened and closed before the main power switch 310 is turned on, and the data in the unit memory has already been read out, so the CPU 3001 advances the process to S44 as it is.

In S44, the CPU 3001 checks the front door detection flag stored in the SRAM 3002. If the front door detection flag is "1" (YES in S44), the front door D1 has not been opened yet before the main power switch 310 is turned on, and data of the developing device memories 140YM, 140MM, 140CM, 140KM, the drum memories 130YM, 130MM, 130CM, 130KM, and the toner bottle memories 180YM, 180MM, 180CM, 180KM have not been read. Therefore, the CPU 3001 advances the process to S45.

In S45, the CPU 3001 reads out the developing device memory data from the developing device memories 140YM, 140MM, 140CM, and 140KM mounted on the developing devices 140Y, 140M, 140C, and 140K, respectively.

In S46, the CPU 3001 reads out the drum memory data from the drum memories 130YM, 130MM, 130CM, and 130KM mounted on the drum units 130Y, 130M, 130C, and 130K, respectively.

In S47, the CPU 3001 reads out the toner bottle memory data from the toner bottle memories 180YM, 180MM, 180CM, 180KM mounted on the toner bottles 180Y, 180M, 180C, 180K, respectively.

Further, in S48, the CPU 3001 writes the developing device memory data, the drum memory data, and the toner bottle memory data read out in S45 to S47 into the SRAM 3002, and advances the process to S49.

On the other hand, when the front door detection flag is "0" (NO in S44), since the front door D1 is opened and closed before the main power switch 310 is turned on and the respective developing device memory data, the respective drum memory data, and the respective toner bottle memory data are already read out, the CPU 3001 advances the process to S49 as it is. In S49, the CPU 3001 writes "0" in the right door detection flag and the front door detection flag, and ends the processing of the flowchart.

<Door Detection Control>

The "door detection control" shown in S10 of FIG. 5 will be described. FIG. 8 is a flowchart showing an example of door detection control. The door open/close check control is executed by the printer unit controller 301 (in particular, CPU 3001). That is, the CPU 3001 executes the door detection control by executing the program stored in the flash memory 3001*a* inside the CPU 3001.

First, in S51, the CPU 3001 checks whether a jam of the sheet is occurring. If a jam is not occurring (NO in S51), the CPU 3001 advances the process to S52.

In S52, the CPU 3001 checks the output (right door latch signal) of the terminal Q of the latch circuit 3010 of the right door switch 313. When the right door latch signal is "L" (YES in S52), the CPU 3001 advances the process to S53. In S53, the CPU 3001 reads out the fixing unit memory data from the fixing unit memory 155M mounted on the fixing unit 155. Further, in S54, the CPU 3001 writes the fixing unit memory data read out in S53 into the SRAM 3002 and advances the process to S55.

On the other hand, when the right door latch signal is "H" (NO in S52), the CPU 3001 advances the process to S55.

In S55, the CPU 3001 checks the output (front door latch signal) of the terminal Q of the latch circuit 3004 of the front door switch 312. When the front door latch signal is "L" (YES in S55), the CPU 3001 advances the process to S56.

In S56, the CPU 3001 reads out the developing device memory data from the developing device memories 140YM, 140MM, 140CM, and 140KM mounted on the developing devices 140Y, 140M, 140C, and 140K, respectively.

In S57, the CPU 3001 reads out the drum memory data from the drum memories 130YM, 130MM, 130CM, and 130KM mounted on the drum units 130Y, 130M, 130C, and 130K, respectively.

In S58, the CPU 3001 reads out the toner bottle memory data from the toner bottle memories 180YM, 180MM, 180CM, 180KM mounted on the toner bottles 180Y, 180M, 180C, 180K, respectively.

Further, in S59, the CPU 3001 writes the respective developing device memory data, the respective drum memory data, and the respective toner bottle memory data read out in S56 to S58 into the SRAM 3002, and advances the process to S60.

On the other hand, when the front door latch signal is "H" (NO in S55), the CPU 3001 advances the process to S60. If a jam is occurring (YES in S51), the CPU 3001 advances the process to S60.

In S60, after the front door D1 and the right door D2 are closed, the CPU 3001 outputs the CLR signals of the latch circuit 3004 and the latch circuit 3010, respectively, and clears the latch circuit 3004 and the latch circuit 3010, thereby ending the processing of the flowchart.

As described above, in the embodiment, the latch circuits 3004 and 3010 for latching that the front door switch 312 and the right door switch 313 are opened are provided, and the power is supplied from the battery 3003 to the latch circuits 3004 and 3010. When the image forming apparatus 1 is activated, the data related to the unit to be replaced by opening the door corresponding to the latch circuit of which the output of the terminal Q is at the "L" level is read out from the memory of the unit. Also, the data related to the unit to be replaced by opening the door corresponding to the latch circuit of which the output of the terminal Q is not at the "L" level is read out from the SRAM 3002 without being read out from the memory of the unit. The activation process is performed on the basis of the read data. With such a configuration, even if the replaceable unit is replaced in any state of the image forming apparatus 1, it can be determined that the front door D1 or the right door D2 was opened during the activation process. Therefore, in a case in which the front door D1 or the right door D2 was opened, the data of the memory of the replaceable unit can be read out, and control can be performed so that the image forming process is optimized. In a case in which the front door D1 and the right door D2 were not opened, the activation process time of the image forming apparatus 1 can be prevented from being extended by accessing the memory after the activation process. That is, it is possible to realize both optimization of the image forming process after a unit replacement and shortening of the activation process time while suppressing increase in cost. In this way, the activation time of the image forming apparatus 1 to which the replaceable unit having the memory is mounted can be shortened with an inexpensive configuration without increasing the cost.

In place of the front door switch 312 and the right door switch 313, various sensors configured to detect the open/closed states of the front door D1 and the right door D2 may be used. The power is supplied from the battery 3003 to the sensors. Although not described in detail, the latch circuits 3004 and 3010 are configured to hold a specific state (for example, the output terminal Q is at the "L" level) when the sensors detect that the front door D1 or the right door D2 is open.

The structure and contents of the various data described above are not limited to this, and it goes without saying that the structure and contents of the various data are various depending on the use and purpose.

Although the embodiment has been described above, the present invention can be implemented as, for example, a system, an apparatus, a method, a program or a storage medium. More specifically, the present invention may be applied to a system comprising a plurality of devices, or may be applied to a device comprising one device. In addition, the combination of the above embodiments is also included in the present invention.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass pass all such modifications and equivalent structures and functions.

This application claims the benefit of Japanese Patent Application No. 2020-120948, filed Jul. 14, 2020, which is hereby incorporated by reference herein in its entirety.

What is claimed is:

1. An image forming apparatus to which a replaceable unit provided with a nonvolatile memory is mounted, the image forming apparatus comprising:

an image forming portion configured to form an image on a sheet;

a storage portion configured to store data related to the replaceable unit read out from the memory provided to the replaceable unit, and hold stored contents even in a power saving state in which a power is not supplied to the image forming portion, a power consumption of the image forming apparatus in the power saving state being smaller than a power consumption of the image forming apparatus in a standby state in which the power is supplied to the image forming portion;

a door to be opened and closed in a case where the replaceable unit is replaced;

a detector configured to detect whether the door is in an open state or in a closed state even in the power saving state;

a latch circuit configured to hold a specific state in a case in which the detector detects that the door is in the open state even in the power saving state; and a controller configured to, in a case where the image forming apparatus is shifted from the power saving state to the standby state, read out the data from the memory of the replaceable unit in a case in which the latch circuit is in the specific state, read out the data from the storage portion without reading out the data from the memory of the replaceable unit in a case in which the latch circuit is not in the specific state, and perform an activation process of the image forming apparatus based on the read out data.

2. The image forming apparatus according to claim 1, wherein the door includes a plurality of doors, wherein said detector and said latch circuit are provided for each of the plurality of doors, and wherein the controller reads out the data related to the replaceable unit, replaced by opening the door and corresponding to the latch circuit in the specific state, from the memory of the replaceable unit, reads out the data related to the replaceable unit, replaced by opening the door and corresponding to the latch circuit not in the specific state, from the storage portion without reading the data from the memory of the replaceable unit, and performs the activation process based on the read out data.

3. The image forming apparatus according to claim 1, wherein after the activation process is completed, the controller reads out the data from the memory of the replaceable unit, and stores the read out data in the storage portion.

4. The image forming apparatus according to claim 1, wherein before the activation process is performed, with respect to the replaceable unit that is replaced by opening the door corresponding to the latch circuit not in the specific state, the controller determines whether or not the replaceable unit is mounted to the image forming apparatus based on whether success or failure of access to the memory of the replaceable unit without reading out the data from the memory of the replaceable unit.

5. The image forming apparatus according to claim 1, wherein in a case in which the controller reads out the data from the memory of the replaceable unit that is replaced by opening the door corresponding to the latch circuit in the specific state, the controller releases the specific state of the latch circuit.

6. The image forming apparatus according to claim 1, wherein the detector is a switch in which a voltage state is changed according to whether the door is in the open state or the closed state, and wherein the latch circuit holds the specific state in response to a predetermined change in the voltage state of the switch.

7. The image forming apparatus according to claim 1, wherein the detector is a sensor configured to detect whether the door is in the open state or the closed state, and wherein the latch circuit holds the specific state in a case in which the sensor detects that the door is in the open state.

8. A method for controlling an image forming apparatus to which a replaceable unit provided with a nonvolatile memory is mounted, the image forming apparatus including an image forming portion configured to form an image on a sheet, a storage portion configured to store data related to the replaceable unit read out from the memory provided to the replaceable unit, and hold stored contents even in a power saving state in which a power is not supplied to the image forming portion, a door to be opened and closed when the replaceable unit is replaced, a detector configured to detect whether the door is in an open state or in a closed state even in the power saving state, and a latch circuit configured to hold a specific state in a case in which the detector detects that the door is in the open state even in the power saving state, a power consumption of the image forming apparatus in the power saving state being smaller than a power consumption of the image forming apparatus in a standby state in which the power is supplied to the image forming portion, the method comprising:

a first reading step of, in a case where the image forming apparatus is shifted from the power saving state to the standby state, reading out the data from the memory of the replaceable unit in a case in which the latch circuit is in the specific state, a second reading step of, in the case where the image forming apparatus is shifted from the power saving state to the standby state, reading out the data from the storage portion without reading out the data from the memory of the replaceable unit in a case in which the latch circuit is not in the specific state; and an activation process step of performing an activation process of the image forming apparatus based on the read out data.

9. An image forming apparatus to which a replaceable unit provided with a nonvolatile memory is mounted, the image forming apparatus comprising:

a power switch which is be operated to bring the image forming apparatus into an activated state and a shutdown state;

a storage portion configured to store data related to the replaceable unit read out from the memory provided to the replaceable unit, and hold stored contents even in the shutdown state;

a door to be opened and closed in a case where the replaceable unit is replaced;

a detector configured to detect whether the door is in an open state or in a closed state even in the shutdown state;

a latch circuit configured to hold a specific state in a case in which the detector detects that the door is in the open state even in the shutdown state; and a controller configured to, in a case where the image forming apparatus is shifted from the shutdown state to the activated state by the power switch being operated, read out the data from the memory of the replaceable unit in a case in which the latch circuit is in the specific state, read out the data from the storage portion without reading out the data from the memory of the replaceable unit in a case in which the latch circuit is not in the specific state, and perform an activation process of the image forming apparatus based on the read out data.

10. A method for controlling an image forming apparatus to which a replaceable unit provided with a nonvolatile memory is mounted, the image forming apparatus including a power switch which is be operated to bring the image forming apparatus into an activated state and a shutdown state, a storage portion configured to store data related to the replaceable unit read out from the memory provided to the replaceable unit, and hold stored contents even in the shutdown state, a door to be opened and closed when the replaceable unit is replaced, and a detector configured to detect whether the door is in an open state or in a closed state even in the shutdown state, a latch circuit configured to hold a specific state in a case in which the detector detects that the door is in the open state even in the shutdown state, the method comprising:

a first reading step of, in a case where the image forming apparatus is shifted from the shutdown state to the activated state, reading out the data from the memory of the replaceable unit in a case in which the latch circuit is in the specific state, a second reading step of, in the case where the image forming apparatus is shifted from the shutdown state to the activated state, reading out the data from the storage portion without reading out the data from the memory of the replaceable unit in a case in which the latch circuit is not in the specific state; and an activation process step of performing an activation process of the image forming apparatus based on the read out data.

* * * * *